United States Patent [19]

Durenec

[11] 4,365,982

[45] Dec. 28, 1982

[54] CRYOGENIC REFRIGERATOR

[75] Inventor: Peter Durenec, Annandale, Va.

[73] Assignee: The United States of America as represented by the Secretary of the Army, Washington, D.C.

[21] Appl. No.: 335,925

[22] Filed: Dec. 30, 1981

[51] Int. Cl.[3] ..... F25B 9/00

[52] U.S. Cl. ..... 62/6

[58] Field of Search ..... 62/6, 514 R

[56] References Cited

U.S. PATENT DOCUMENTS 3,851,173 11/1974 Taylor et al. ..... 62/514 R 4,277,948 7/1981 Horn et al. ..... 62/6

*Primary Examiner*—Ronald C. Capossela

*Attorney, Agent, or Firm*—Nathan Edelberg; Milton W. Lee; Aubrey J. Dunn

[57] ABSTRACT

Two embodiments of a Stirling cooler are shown. Each embodiment includes the usual compressor portion and cold finger portion. The compressor is improved by inserting a vibration damper in the master piston rod by employing a unique evacuating-charging valve, and be inserting an in-line filter in the cryogen passageway between compressor and cold finger. The cold finger is improved by lining the inside of the displacer-regenerator piston with a highly reflective coating and by inserting a good heat conducting spring between the end of the piston and the opposite wall of the cold finger expansion chamber. In one embodiment, the drive for the compressor crankshaft is improved by using herringbone reduction gears with the layer gear counterbalanced and by using a torsional drive shaft between the electric drive motor and the small herringbone gear. The other embodiment uses direct torsion-shaft drive of the crankshaft, but with a counterbalance on the crankshaft in the form of a weight on a flexible arm.

5 Claims, 4 Drawing Figures

CRYOGENIC REFRIGERATOR

The invention described herein may be manufactured, used, and licensed by the U.S. Government for governmental purposes without the payment of any royalties thereon.

BACKGROUND OF THE INVENTION

This invention is in the field of cryogenic coolers, particularly those mechanical types known as Stirling-cycle coolers. Typical examples of such coolers are shown in U.S.Pat. No. 3,851,173 and 4,277,948. Although such coolers have various known advantages, such as the ability to readily reach and to maintain cryogenic temperatures for extended times, they do have disadvantages as to noise, vibration, efficiency, and durability. The main causes of such noise and vibration are the facts that unbalanced rotating and reciprocating parts are used and that, by its very nature, a compressor presents a cyclic load to its drive motor. Of course, the durability or mean time between failures (MTBF) of the cooler is affected because of uneven bearing or journal loads. Moreover, the efficiency of the known coolers is degraded by heat leakage into (or from) the cooler cold finger portions. The instant invention is an improved version of the cooler as shown in U.S. Pat. No. 3,851,173, and, compared thereto, has reduced noise and vibration and greater efficiency and MTBF.

SUMMARY OF THE INVENTION

The invention is an improved Stirling cooler, compared to the cooler in U.S. Pat. No. 3,851,173 to Taylor et al. This invention, is one embodiment, differs from the Taylor et al patent is that it employes a torsion bar drive shaft from the electric motor directly driving the cooler crankshaft, uses a master piston rod with a vibration damper therein, has the interior of its regenerator lined with a highly reflective coating, has a good heat-conducting spring between the end of its displacer-generator piston and its cold cap, employs a unique vacuum-fill valve, and has a crankshaft counterbalance consisting of a weight on a flexible arm. An alternate embodiment of this invention omits the last-mentioned counterbalance and uses herringbone reduction gears instead of direct drive. The larger of the reduction gears is fixed to the crankshaft and is counterbalanced.

DESCRIPTION OF THE PREFERRED EMBODIMENTS

Figure 1:
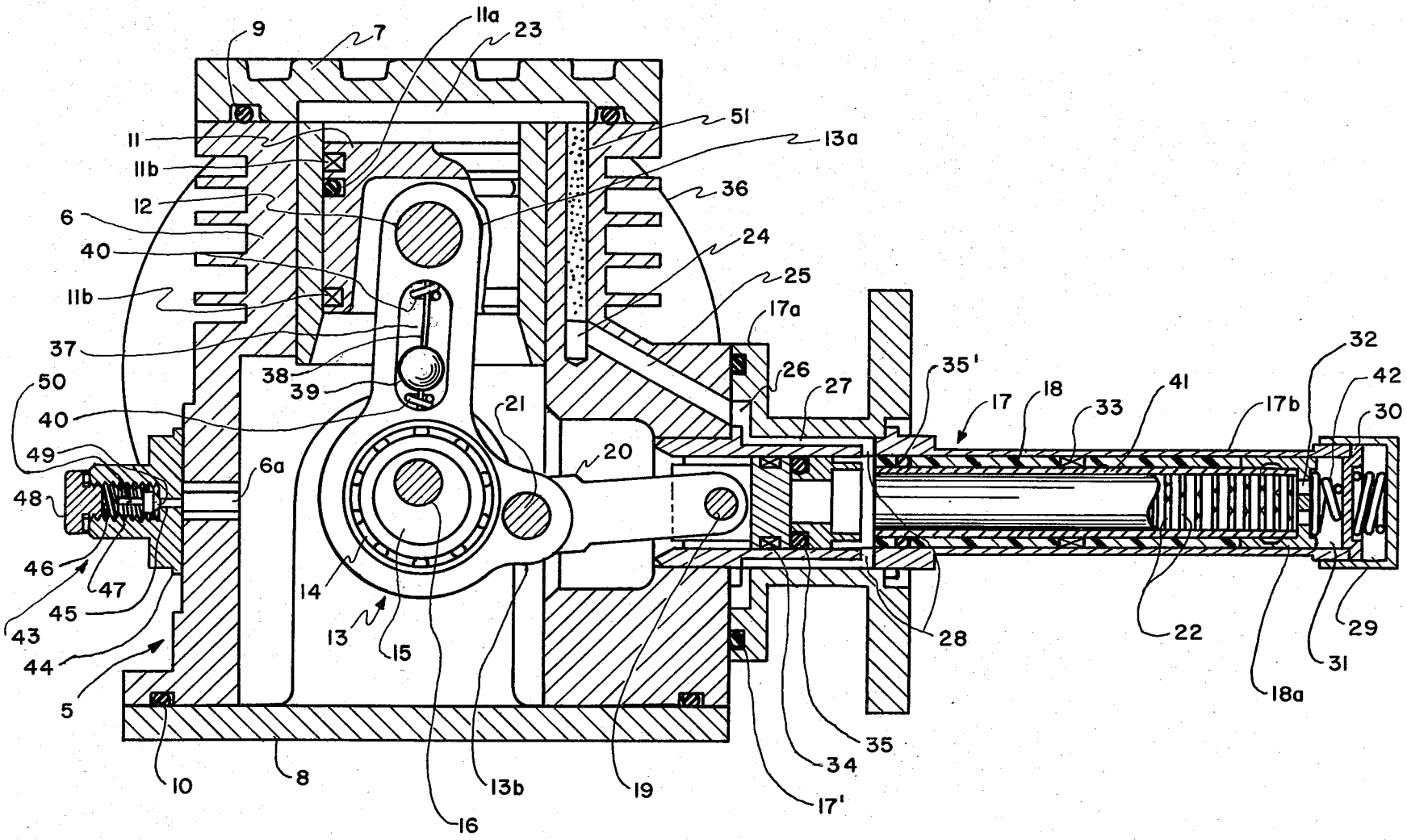
FIG. 1 shows a sectional view of the invention.

The invention may be best understood when this description is taken in conjunction with the drawings. FIG. 1 thereof shows a housing generally designated 5, having body 6 and end caps 7 and 8. These caps may be bolted (bolts not shown) onto body 6, with seals 9 and 10 in groves of the caps to form gas-tight joints. Within body 6 is a compression piston 11 with sealing ring 11*a* and guides 11*b* and piston pin 12. This pin passes through one end of a first arm 13*a* of master piston rod

13. Rod 13 is journaled by bearing 14 on eccentric cam 15 of drive shaft 16. Mounted on one side of housing body 6 is cooling a head generally designated 17, and have flange end 17*a* and cold finger end without wall 17*b*. Within 17 is a contained regenerator-displacer piston with shell 18 and having pin 19 at one end thereof. This pin carries one end of connecting rod 20 and the other end of 20 is carried by pin 21 journaled to arm 13*b* of master piston rod 13. Seal 17' is between flange end 17*a* of the cold finger and housing body 6. Although not shown, it should be understood that caps 7 and 8 and cooling head 17 are all held onto housing body 6 by suitable fastening devices such as bolts. Shell 18 of the regenerator-displacer piston, as is usual in this type of refrigerator, is made of some lightweight plastic and is generally hollow, but does have a porous heat-exchange material therein, such as a plurality of mesh metal screens 22, and has metal end 18*a*.

End caps 7 of housing body 6 has a compression space 23 therein communicating with passageways 24 and 25 in body 6. In cooling head 17 passageways 26 and 27 continue from 25; 27 in turn connects to ports 28 passing into the cylinder containing the displacer-regenerator piston. The generally hollow interior of this piston thus communicates with compression space 23. In operation, all of 23, 24, 25, 26, 27, 28, and the interior of the displacer- regenerator piston are filled with a cryogen such as helium.

Cold finger end 17*b* is covered by cold cap 29. Between 29 and end cap 30 of 17*b* is a coil spring of a good heat conducting material such as copper or phosphor bronze. Within 17 is expansion chamber 31 communicating with the hollow interior of the displacer-generator piston by holes 32 in the end of shell 18. Naturally, 31 and 32 also contain the cyogen of the system. Shell 18 is supported by supports 33 and 34 and sealed by seals 35 and 35' in their respective grooves. Shaft 16 which drives the refrigerator is normally turned through spur reduction gears (not shown), one gear attached to 16, and another attached to the armature (not shown) of electric motor 36.

Figure 3:
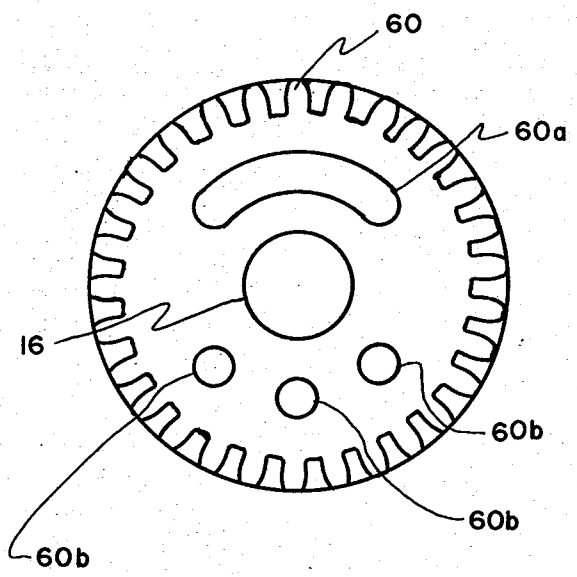
FIG. 3 shows further partly sectional detail of the first embodiment.

Thus far, all of the elements of the refrigerator as described are well known in the art, as exemplified in FIG. 3 of U.S. Pat. No. 3,851,173. The improvements over this prior art will now be described, beginning with master piston rod 13. Arm 13*a* of this rod has slot 37 milled (or otherwise formed) therein, with rod 38 longitudinally mounted therein. On rod 38 is weight 39 and springs 40. Elements 38, 39, and 40 act as a vibration damper for the arm. The next improvements have to do with cold finger 17. First, shell 18 is plated or otherwise coated on its inside surface with a thin, highly reflective to heat layer. This layer may be nickel, chromium, aluminum or some such metal which will provide a high-polish surface. Second, conical spring 42 between metal end 18*a* of shell 18 and end cap 30 of the cold finger. This spring 42 is of phosphor-bronze or some other good heat-conducting spring material, and provides for good heat transfer between 18*a* and 30. The third improvement shown in FIG. 1 is vacuum-charging valve generally designated 43. The usual manner by which a refrigerator as herein described is vacuum pumped and charged with helium is a "pinch connection." With this connection soft copper tubing is brazed or otherwise joined to the refrigerator housing. Vacuum is pumped through this tubing and helium is charged therethrough, then the tube is pinched off. Unfortunately, the pinch provides an unreliable seal.

Attempts to improve the seal by soldering the pinch often result in enough thermal expansion for the pinch to crack open and for helium to be lost. Moreover, a pinch connection is not reusable if the refrigerator must be disassembled or recharged. The improved valve includes a housing 44 mounted to body 6 of housing 5; the housing may be brazed or bolted to to 6 with the proper gaskets as needed. Though body 6 opening 6*a* communicates with bore 45 in housing 44. Housing 44 also has threaded bore 46 therein, with set screw 47 and plug 48 threaded into 46. Set screw 47 has a depression in one end into which ball 49 is peened, stroked or otherwise held, and has at least three longitudinal slots, such as 50, cut through its threads. In use, before plug 48 is inserted a evaculating-charging connector (not shown) is screwed into 46 and set screw 47 is partly back out by a wrench is cavity (not shown) in the opposite end of 47 from ball 49. Vacuum is pumped through slots 50, bore 45, and bore 6*a*. The seals 11*a* and 35, as usually employed, have slight leakages so that the various passageways and other spaces can be vacuum pumped; such leakages have insignificant effect when the refrigerator is running. After vacuum is pumped, helium is admited through 43 to charge the refrigerator. Set screw 47 is turned in to seat ball 49 against the end of bore 45. Ball 49 is preferably of a material harder then the material of housing 44; if the housing is brass, the ball may be steel. Alternatively, bore 45 may be a soft metal seat at the end adjacent ball 49. In any event, a gas-tight, metal-to-metal seal is achieved. After ball 49 is seated, the evacuating charging connector is removed, and plug 48 is screwed into bore 46.

The last improvement in FIG. 3 is filter material 51 is passageway 24. In the event that particles are trapped in space 23 or that wear particles appear, the filter prevents their reaching the cold finger. They may be sintered metal powder or the like.

Figure 2:
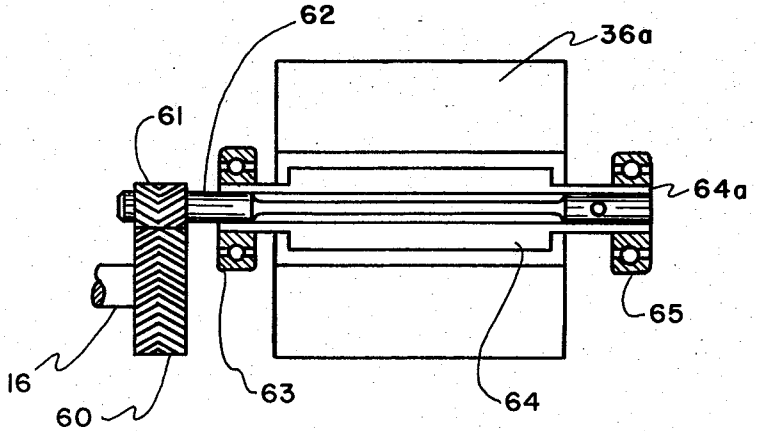
FIG. 2 shows a partly sectional detail of a first embodiment of the invention.
Figure 4:
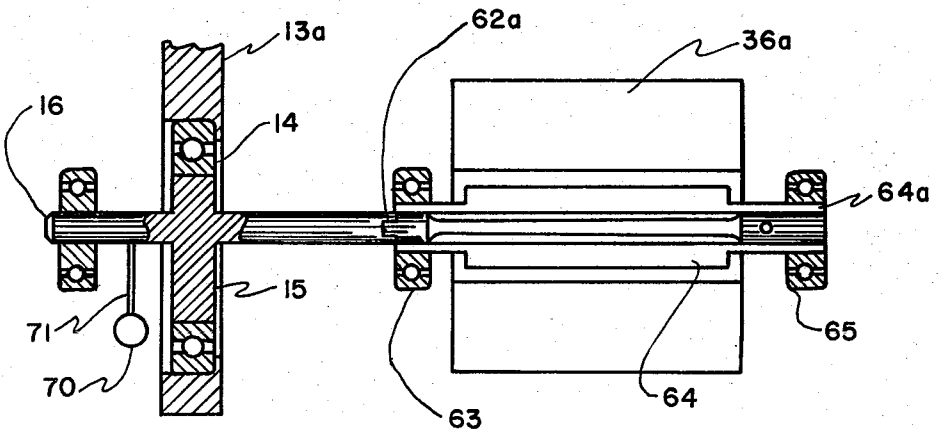
FIG. 4 shows a partly sectional detail of a second embodiment of the invention.

Further improvements of the invention are shown in FIGS. 2–4. Specifically, FIGS. 2 and 3 show detail views of the embodiment of the invention using a reduction gear drive. FIG. 2 shows a portion of drive shaft 16 from FIG. 1, with large herringbone gear 60 attached thereto. This gear meshes with small herringbone bear 61 mounted on the rotor shaft 62. This shaft is supported by bearing. It should be understood the bearing 63 and motor stater 36*a* are all contained in the housing of motor 36 of FIG. 1. Shaft 62 passes through a bore in rotor 64 and is attached to 64 at end 64*a*. Bearing 65 supports 64*a* and is in turn supported by the housing of motor 36 (FIG. 1). Shaft 62 is in the form of a flexible rod or torsion bar and twists slightly when the refrigerator is operating. This twisting tends to smooth out the torque curve to shaft 16 and reduce vibration. Herringbone gears 60 and 61 operate much quieter and are longer lasting than the usual spur gears used in a refrigerator of this type. FIG. 3 shows a side view of gear 60. This gear is modified from the usual herringbone shape by being milled out and counterweighted to balance the compressor piston and master piston rod masses. Specifically, 60 has arcuate opening 60*a* and other openings 60*b* which are filled with a hard heavy metal such as tungsten.

FIG. 4 shows details of an embodiment of the invention wherein shaft 16 is directly driven by rotor shaft 62*a*. In order to balance the mass of the compression piston and master piston rod, weight 70 is carried at the end of flexible arm 71.

The amount of material removed from arm 13*a* to form slot 37 is about 10–15% of the mass of rod 13. Weight 39 is about three times the removed mass. Springs 40 must be able to absorb 3.5 g. of weight 39 without permanent deformation. The amount of material removed from opening 60*a* of gear 60 is about 14–16% of the mass of 60, and the counterweights in openings 60*b* is about 18–20% of the original mass of 60. Torsion bars 62 and 62*a* are able to absorb 8% of the maximum torque required to operate the compressor, with a 5° twist. Weight 70 of FIG. 4 has a mass approximately equal to the mass of piston 11. Arm 71 is made of spring wire as long as possible inside housing 5 and is sufficiently limber to flex slightly with variations in the rotational velocity of shaft 16. Valve 43 as shown, and in another embodiment, is the subject of U.S. Pat. application Ser. No. 335,926, filed Dec. 30,1981 entitled *Evacuating-Charging Valve Assembly* and assigned to the same assignee as this invention.

I claim:

1. An improved cryogenic refrigerator including a housing, an electric motor mounted on said housing and having a rotor and a rotor shaft, a drive shaft in said housing, means for transmitting torque from said rotor shaft to said drive shaft, whereby said drive shaft has an eccentric cam thereon, and whereby a master piston rod is journaled on said cam and has first and second orthogonal arms, a compression cylinder in and a cooling head on said housing, said cooling head having a cylinder therein and having a flange end mounted to said housing and a cold finger end directed away from said housing, a compression piston in said compression cylinder and having a piston pin thereon journaled to said first arm, a regenerator-displacer piston in said cooling head cylinder and having a piston pin, a connecting rod with a pin on one end journaled to said second arm of said master rod and journaled on the other end to the pin of said regenerator-displacer piston, whereby said cooling head includes a cold cap at said cold finger end and an expansion chamber defined by an end of said regenerator-displacer piston and by said cold cap, whereby said regenerator-displacer piston is hollow and is filled with porous heat-exchange material, a cryogen passageway between said compression cylinder and the cylinder of said cold finger, whereby said compression cylinder, said passageway, and the cylinder of said cold finger and the porous spaces of said heat-exchange material are filled with a cryogen, whereby said drive shaft rotates said rotor shaft rotates and, through said master piston rod, causes said pistons to reciprocate in their cylinders, the improvement comprising:

a rotor shaft on said motor which is in the form of a torsion bar extending through said rotor and affixed thereto at the end of said rotor away from said housing.

2. The refrigerator as recited in claim 1 wherein said means for transmitting torque includes a reduction gear set, with a small gear of the set carried by and affixed to said rotor shaft and with a large gear of the set carried by and affixed to said drive shaft, the further improvement being: said large gear is counterweighted to balance the mass of said compression piston on said drive shaft.

3. The refrigerator as recited in claim 1 wherein said rotor shaft and said drive shaft are coaxially connected and wherein the following improvement is: a counterweight on said drive shaft for the weight of said compression piston, wherein said counterweight consists of a flexible arm affixed orthogonally to said drive shaft and with a dense weight at the unfixed end thereof.

4. The refrigerator as recited in any one of claims 1, 2, and 3 wherein the additional improvement is: a longitudinal slot is formed in said first arm of said master piston rod, a weight rod is in said slot, is coaxial therewith, and has its ends affixed to said master piston rod, a weight slidably mounted on said weight rod, and two springs on said weight rod, one on either side of said weight.

5. The regenerator as recited in any one of claims 1, 2, and 3 wherein the additional improvement is: a coil spring in said expansion chamber, biased between said cold cap and the end of said regenerator-displacer piston adjacent thereto.

* * * * *